United States Patent [19]

Ellis

[11] Patent Number: 4,658,872

[45] Date of Patent: Apr. 21, 1987

[54] CUP LOCATOR FOR BEVERAGE DISPENSER

[75] Inventor: Annie T. Ellis, Smyrna, Ga.

[73] Assignee: The Coca-Cola Company, Atlanta, Ga.

[21] Appl. No.: 756,001

[22] Filed: Jul. 17, 1985

[51] Int. Cl.[4] ..... B65B 3/04

[52] U.S. Cl. ..... 141/311 R; 141/369

[58] Field of Search ..... 141/369–371, 141/94–96, 311 R

[56] References Cited

U.S. PATENT DOCUMENTS

| | | | |
|---|---|---|---|
| 476,795 | 6/1892 | Hatfield | 141/234 |
| 967,343 | 8/1910 | Dietz | 141/234 |
| 1,654,004 | 12/1927 | Lind | 141/234 |
| 1,938,416 | 12/1933 | Cook | 312/44 |
| 1,982,535 | 11/1934 | Patterson | 225/21 |
| 2,000,556 | 5/1935 | Brady | 194/13 |
| 2,095,201 | 10/1937 | Mills | 225/21 |
| 2,133,770 | 10/1938 | McGlohon | 221/69 |
| 2,156,834 | 5/1939 | Berry | 225/21 |
| 2,307,589 | 1/1943 | Johnson | 225/21 |
| 2,426,707 | 9/1947 | Polsen | 312/44 |
| 2,472,921 | 6/1949 | Quimper | 225/21 |
| 2,558,522 | 6/1951 | Knapp | 225/21 |
| 2,569,486 | 10/1951 | Mills | 225/21 |
| 2,571,283 | 10/1951 | Nicholson | 225/21 |
| 2,591,507 | 4/1952 | Brous | 222/21 |
| 2,682,984 | 7/1954 | Melikian | 226/46.6 |
| 3,045,719 | 7/1962 | Burks | 141/104 |
| 3,160,324 | 12/1964 | Nixon | 222/144.5 |
| 3,364,959 | 1/1968 | Herman et al. | 141/155 |
| 3,384,268 | 5/1968 | Egee | 222/1 |
| 3,592,355 | 7/1971 | Manzer et al. | 221/11 |
| 3,849,970 | 11/1974 | Kinney | 53/282 |
| 3,913,792 | 10/1975 | Brill et al. | 222/144.5 |
| 4,276,750 | 7/1981 | Kawasumi | 62/137 |

FOREIGN PATENT DOCUMENTS

| | | | |
|---|---|---|---|
| 681331 | 8/1939 | Fed. Rep. of Germany | 141/378 |

*Primary Examiner*—Houston S. Bell, Jr.

*Attorney, Agent, or Firm*—Thomas R. Boston

[57] ABSTRACT

The cup locator includes a straight rear wall about 1" long and a pair of spaced-apart, straight, angled side walls, one at each end of the rear wall, about 1" long and each at an obtuse angle of about 150° to the rear wall. Differently sized beverage cups, placed against the rear wall of this cup locator, will be properly positioned below the nozzle of a beverage dispenser valve assembly.

7 Claims, 6 Drawing Figures

CUP LOCATOR FOR BEVERAGE DISPENSER

BACKGROUND OF THE INVENTION

1. Field of the Invention

This invention relates to beverage dispensers and more particularly to a cup locator for properly positioning a variety of different sizes of cups under a beverage dispenser valve assembly.

2. Description of the Prior Art

It is known to provide a cup locator for properly positioning a variety of different sizes of cups on a grate below a beverage dispenser valve assembly, as shown, for example, in U.S. Pat. No. 3,913,792. However, when different sizes of cups are pushed into abutting contact with the prior art "V" shaped cup locator, the bottom edges and thus the lips of the cups may be in different locations, over an unacceptably large range, in the front to back direction, with respect to the nozzle. This creates a problem with respect to certain types of beverage dispensing valve assemblies, such as, for example, those that use ultrasonic energy reflected from a cup lip to a receiver located behind the nozzle, and those that use portion controls.

It is an object of the present invention to provide a cup locator that is not subject to the disadvantages of the prior art cup locator.

It is another object of the present invention to provide a cup locator that can properly position a large variety of different sizes of cups below a valve assembly of a beverage dispenser.

It is a further object of this invention to provide a cup locator that will position the rear edge of the bottoms of cups of different sizes at the same identical position with respect to the nozzle of a beverage dispenser valve assembly, and which will also position the lips within an acceptable range of positions with respect to the nozzle.

It is another object of the present invention to provide such a cup locator that is adjustable in position below a valve assembly.

SUMMARY OF THE INVENTION

A cup locator including an elongated bar with a pair of spaced-apart side arms providing three cup locating walls, including a straight rear wall and a pair of spaced-apart angled side walls, at an obtuse angle to the rear wall. The three walls are all about 1/10" high, about 1" long, and the two side walls are preferably at an angle of about 148° to the rear wall. The cup locator includes adjustable means for connecting it to a grate to allow it to be positioned at the desired location on the grate.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
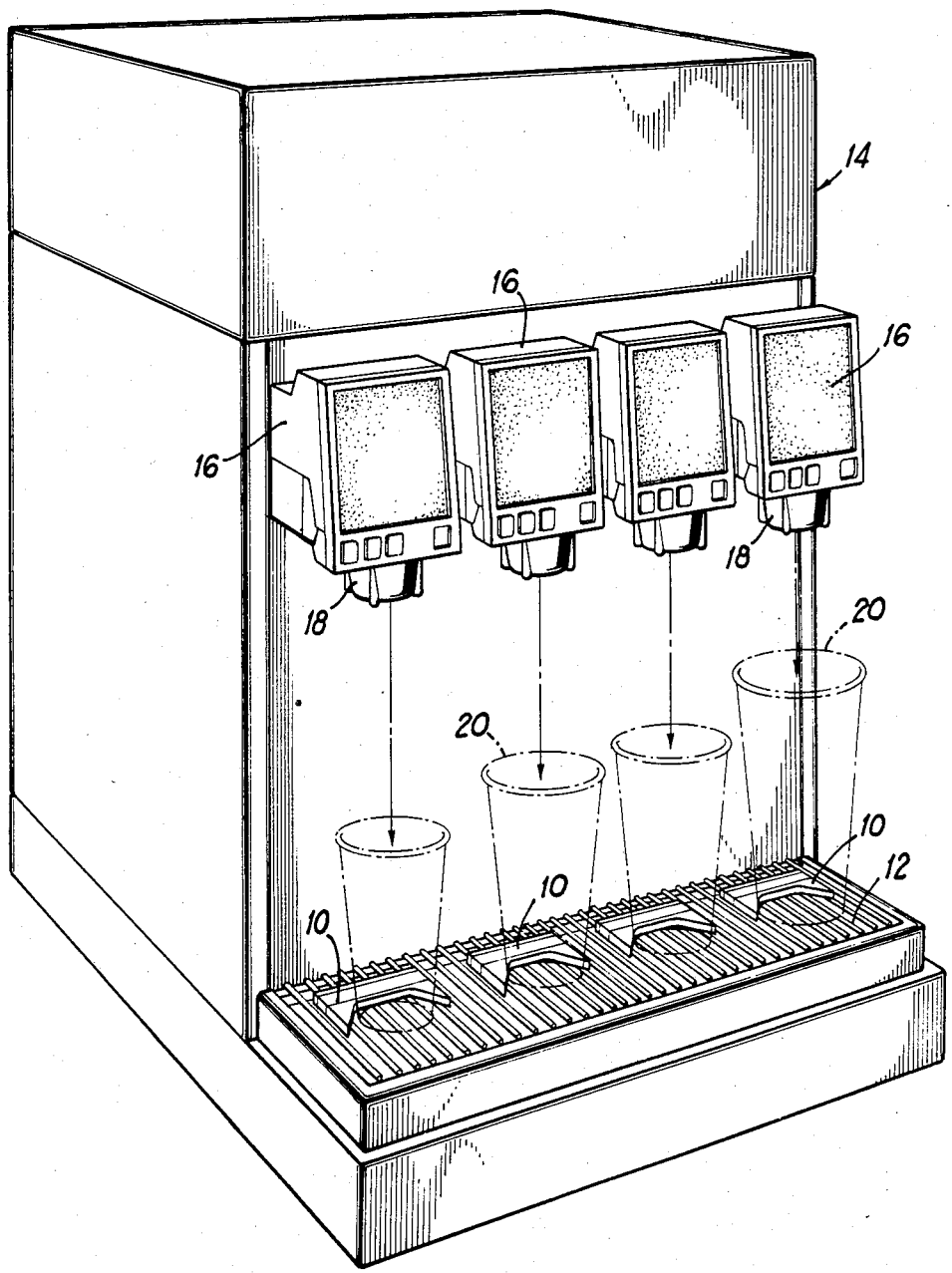
FIG. 1 is a perspective view of a beverage dispenser having four valve assemblies thereon and having a cup locator of the present invention under each valve assembly.

With reference now to the drawings, FIG. 1 shows four cup locators 10 according to the present invention attached to a grate 12 of a beverage dispenser 14. The beverage dispenser has four valve assemblies 16 and a cup locator 10 is positioned below each valve assembly and is affixed to the grate 12 in the proper position relative to the nozzles 18 of the valve assemblies 16 to ensure that, regardless of what size cup 20 (within a given range of cup sizes) is placed below a particular nozzle and up against a rear wall of the cup locator, all of the beverage to be dispensed will flow into the cup 20.

Figure 2:
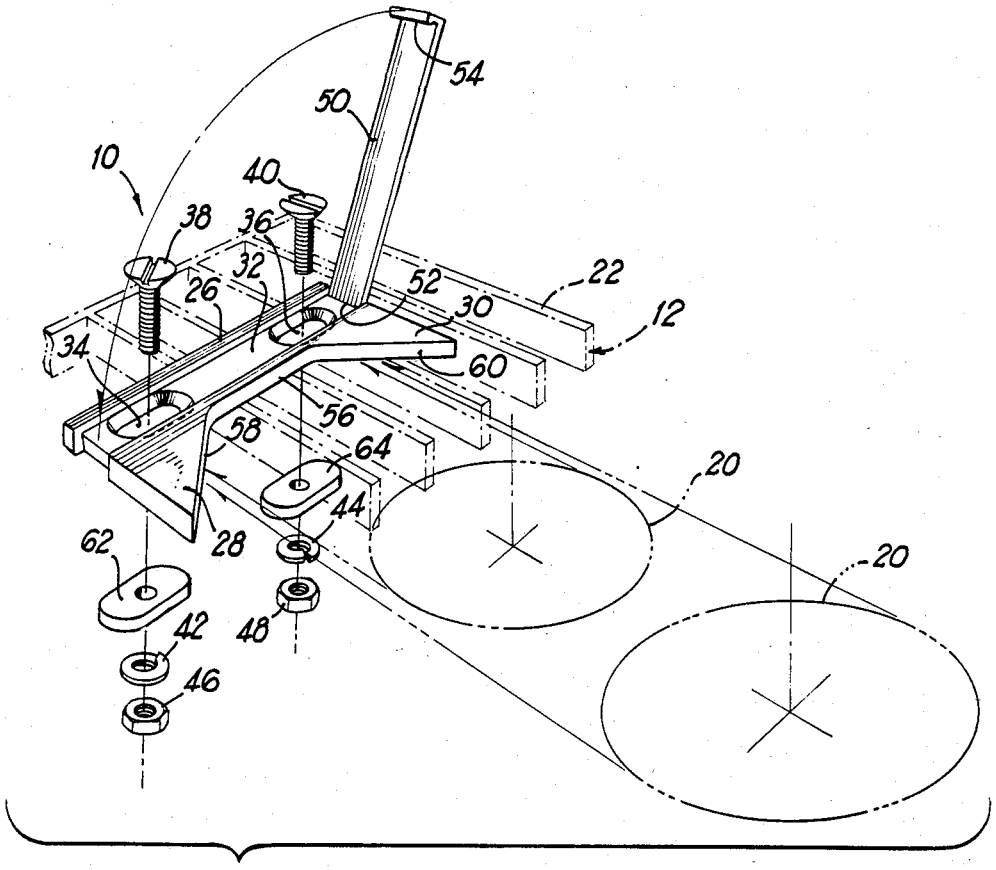
FIG. 2 is a perspective, exploded view of the cup locator of the present invention.
Figure 4:
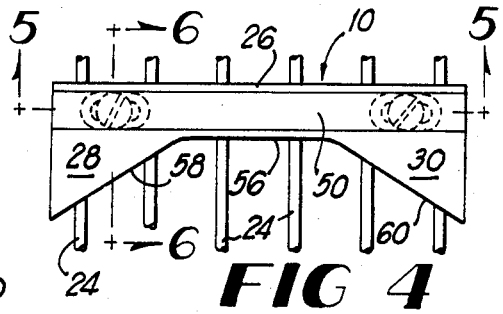
FIG. 4 is a top plan view of the cup locator of FIG. 2.
Figure 3:
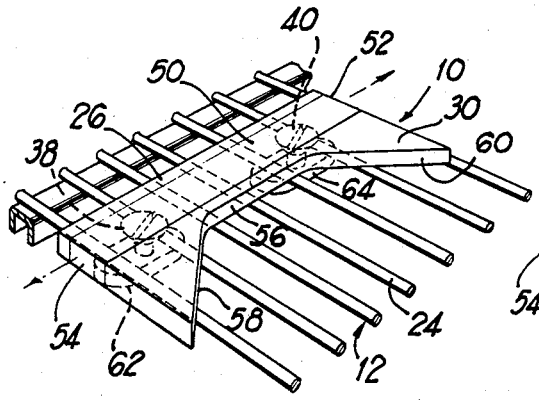
FIG. 3 is a perspective view of the cup locator of FIG. 2 connected to a grate.
Figure 5:
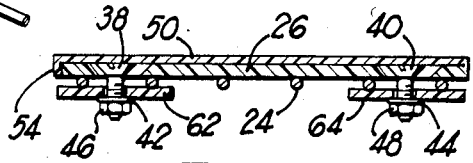
FIG. 5 is a cross-sectional view of the cup locator of FIG. 2 taken along line 5—5 of FIG. 4.
Figure 6:
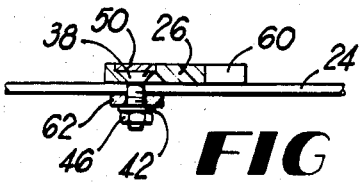
FIG. 6 is a cross-sectional view of the cup locator of FIG. 2 taken along line 6—6 of FIG. 4.

FIGS. 2 to 6 show the cup locator 10 in detail. It is noted that the grate 12 can consist of flat plates 22 on edge as shown in FIG. 2, or can consist of rods 24 as shown in FIG. 3. Also, the grate rods or plates can extend from front to back as shown in FIGS. 1 to 6 or from side to side (not shown) in which case the slots 32 and 34 in the cup locator 10 should run from front to back.

The cup locator 10 comprises a flat elongated bar 26 having a pair of side arms 28 and 30. The bar 26 has a groove 32 provided with a pair of slots 34 and 36. An attachment means is associated with the slots 34 and 36 for connecting the cup locator 10 to the grate, including screws 38 and 40, lockwashers 42 and 44, nuts 46 and 48, and clamp plates 62 and 64, respectively.

The bar 26 also includes a cover 50 hinged at 52 and including a snap 54, for folding over on top of the screw heads in the groove 32 to provide a smooth appearance to the cup locator 10 when affixed in position. The attachment means allow the cup locator 10 to be positioned at any desired location on the grate 12.

The cup locator 10 provides three cup locating walls including a rear wall 56 and two side walls 58 and 60. The height or thickness of the cup locator 10 is preferably about 1/10". The length of the rear wall 56 is preferably 1" and the length of the side walls is preferably 1.06". The sidewalls 58 and 60 are preferably at an obtuse angle of 148° to the rear wall 56. These parameters ensure that any one of a variety of differently sized cups, when the cup is pushed back against the rear wall 56 of the cup locator 10, will be properly positioned under the nozzle 18. The different sizes of cups for which this is true includes all cups that vary between having a bottom diameter of 2" to 3½". A cup having a 2" bottom diameter typically holds 12 ozs. and a cup having a 3½" bottom diameter typically holds either 32 ozs. or 46 ozs.

The preferred position for the cup locator 10 below the nozzle 18 is that, with respect to the right to left direction, the center of the rear wall 56 should be in-line with the center-line of the nozzle 18. With respect to the front-to-back direction, the rear wall 56 should be about 1.35 inches behind the center-line of the nozzle.

It is not essential that the cup locator 10 have the preferred parameter for the lengths of the three walls 56, 58 and 60, and for the angle of the side walls 58 and 60 to the rear wall 56. The overall length of the cup locator 10 (the left to right distance in FIG. 4) is preferably less than 2¾". The rear wall is preferably about 1"

long and the side walls are preferably at an angle of about 150°, and have a length of about 1". The rear wall can be shorter and the obtuse angle larger, or the rear wall could be longer and the obtuse angle smaller. The length of the rear wall can be from about 0.1 to 1.2 inches and the obtuse angle can var from about 176 to 142 degrees.

The cup locator 10 can be made of any desired material, however, it is preferably molded of polypropylene.

While the preferred embodiment of this invention has been described above in detail, it is to be understood that variations and modifications can be made therein without departing from the spirit and scope of the present invention as set forth in the appended claims. For example, other attachment means can be used including other types, numbers and arrangements of attachment devices. The hinged cover can be omitted if desired or can be hinged differently and provided with different means for holding it in place. The height and width of the cup locator 10 can be varied.

What is claimed is:

1. A cup locator for a beverage dispenser comprising:

(a) an elongated bar and a pair of spaced-apart side arms connected to said bar and extending away from the same side of said bar on opposite ends thereof;

(b) said bar including a straight rear wall and each of said side arms including a straight side wall facing toward said bar for properly laocating a cup placed in abutting relationship against said rear wall of said cup locator; and (c) said side walls each being at an identical, obtuse angle to said rear wall and extending in opposite directions from said rear wall.

2. The cup locator as recited in claim 1 wherein said rear wall has a length of approximately one inch and said obtuse angle is approximately 150°.

3. The cup locator as recited in claim 1 wherein said rear wall has a length of 1", said side walls have a length of 1.06", said angle is 148°, and said walls have a height of about 1/10".

4. The cup locator as recited in claim 1 including means for adjustably connecting said cup locator to a grate of a beverage dispenser.

5. The cup locator as recited in claim 1 including a beverage dispenser having a valve assembly with a nozzle, a grate located below said nozzle, and said cup locator being positioned below said nozzle on said grate for positioning the rear edge of the bottom of a variety of different sizes of cups abutting said rear wall, at the same identical front-to-back distance behind the centerline of said nozzle.

6. The cup locator as recited in claim 5 wherein said distance is about 1.35 inches.

7. The cup locator as recited in claim 1 wherein said rear wall has a length of from about 0.1 to 1.2 inches and said obtuse angle varies from about 176° to 142°.

* * * * *